US006168110B1

(12) United States Patent
Stevens et al.

(10) Patent No.: US 6,168,110 B1
(45) Date of Patent: Jan. 2, 2001

(54) DUAL BOBBIN MANDREL

(75) Inventors: William H. Stevens, Deltaville, VA (US); Keith Richard Koenig, Jeffersonville; Robert Eugene Marcum, Greenville, both of IN (US)

(73) Assignee: Philip Morris Management Corp., New York, NY (US)

( * ) Notice: Under 35 U.S.C. 154(b), the term of this patent shall be extended for 0 days.

(21) Appl. No.: 09/028,341

(22) Filed: Feb. 24, 1998

(51) Int. Cl.[7] ..... G65H 75/24
(52) U.S. Cl. ..... 242/573.9
(58) Field of Search ..... 242/530.3, 573, 242/573.1, 573.9; 279/2.03, 2.1, 2.11, 2.12

(56) References Cited

U.S. PATENT DOCUMENTS

| | | | | |
|---|---|---|---|---|
| 2,733,873 | * | 2/1956 | Petersen | 242/573.9 |
| 3,226,527 | * | 12/1965 | Harding | 219/384 |
| 3,311,383 | * | 3/1967 | Cox | 279/2.03 |
| 3,456,893 | * | 7/1969 | Michelson | 242/573.7 |
| 3,667,697 | * | 6/1972 | Binder | 242/575.3 |
| 3,792,868 | * | 2/1974 | Flagg | 279/2.01 |
| 3,965,327 | * | 6/1976 | Ehlscheid et al. | 219/121.72 |
| 4,049,945 | * | 9/1977 | Ehlscheid et al. | 219/121.67 |
| 4,118,619 | * | 10/1978 | McArthur et al. | 219/121.7 |
| 4,121,595 | * | 10/1978 | Heitmann et al. | 131/281 |
| 4,140,287 | * | 2/1979 | Hutzenlaub | 242/573 |
| 4,175,715 | * | 11/1979 | Raynor | 242/573.9 |
| 4,265,254 | * | 5/1981 | Koch et al. | 131/281 |
| 4,302,654 | * | 11/1981 | Bennett et al. | 219/121.7 |
| 4,307,851 | * | 12/1981 | Dunaevsky et al. | 242/530.3 |
| 4,378,480 | * | 3/1983 | Langhans | 219/121.7 |
| 4,404,454 | * | 9/1983 | Taylor et al. | 219/121.7 |
| 4,410,785 | * | 10/1983 | Lilly, Jr. et al. | 219/121.7 |
| 4,439,663 | * | 3/1984 | Lilly, Jr. et al. | 219/121.7 |
| 4,767,909 | * | 8/1988 | Okumoto | 219/121.7 |
| 4,798,349 | * | 1/1989 | Manservisi | 242/551 |
| 4,916,272 | * | 4/1990 | Okumoto et al. | 219/121.7 |
| 5,060,668 | * | 10/1991 | Weinhold | 131/281 |
| 5,092,350 | * | 3/1992 | Arthur et al. | 131/281 |
| 5,210,390 | * | 5/1993 | Okumoto | 219/121.7 |
| 5,403,990 | * | 4/1995 | Fukuchi | 219/121.7 |
| 5,404,889 | * | 4/1995 | Belvederi et al. | 131/281 |

FOREIGN PATENT DOCUMENTS

| | | | | |
|---|---|---|---|---|
| 57-72724 | * | 5/1982 | (JP) | 242/530.3 |
| 57-81046 | * | 5/1982 | (JP) | 242/530.3 |

* cited by examiner

*Primary Examiner*—Donald P. Walsh
*Assistant Examiner*—William R. Rivera
(74) *Attorney, Agent, or Firm*—Clinton H. Hallman, Jr.; Kevin B. Osborne; Charles E. B. Glenn

(57) ABSTRACT

An improved mandrel for use on a dual bobbin spindle apparatus, the mandrel being an expandable contractible cylindrical sleeve having a plurality of expansion members and at least one interstitial resilient member separating the expansion members, providing positive engagement of a plurality of reels or bobbins containing wound webs of flexible material.

20 Claims, 3 Drawing Sheets

DUAL BOBBIN MANDREL

1. BACKGROUND OF THE INVENTION

A. Field of the Invention

The present invention relates to an apparatus for holding multiple bobbins of flexible material while those bobbins are mounted on a single spindle capable of very high speed rotation.

B. Description of the Prior Art

Various types of adjustable chucks are known for use in connection with the reception of a reel of material, e.g. a bobbin of paper on a core, which has been wound and is to be unwound therefrom or upon which the web of material is to be wound.

One type of device uses an expandable member to engage the core or reel to hold it while the bobbin is spinning. U.S. Pat. No. 3,456,893 describes such a mandrel assembly. A plurality of arcuate segments are provided which define the outer mandrel surface. An internal cam forces the outer members outward to secure the bobbin. A similar device is described in U.S. Pat. No. 2,733,873, excepting that the mandrel is formed with flexible surface portions.

U.S. Pat. No. 4,175,715, issued to Raynor, describes a spindle apparatus for mounting a reel for winding and unwinding of web material off and on the reel. Such spindle apparatus is said to include a shaft slidable along a fixed axis and to which is fixed a wedging core, the wedging core being concentric with the fixed axis and conical.

An expandable and contractible mandrel is said to encircle the core and provides the structure on which the reel is received. Sliding the shaft in one direction moves the wedging core in contact with the internal surface of the mandrel for expanding against a reel received on the mandrel. Sliding the shaft in an opposite direction moves the wedging core out of contact with the mandrel and allows it to contract.

U.S. Pat. No. 4,175,715 also describes the mandrel as having a hollow cylindrical sleeve member having an external flange at one end. The sleeve is said to have a plurality of axially directed slits which extend along the sleeve body in circumferentially uniformly spaced relationship around the sleeve. Adjacent slits in the sleeve extend from opposite tip ends of the sleeve in the direction of the other sleeve end and terminate closely adjacent to (but spaced from) the other end of the sleeve.

The mandrel sleeve thus described is said to be a contiguous structure of circumferentially spaced ribs, the ribs being joined at the ends thereof with adjacent ribs in alternating manner. The result is said to be a sleeve member which expandable to a considerable degree since the connecting structure at the ends of the ribs and the ribs themselves become levers which can be bent in the circumferential direction to enhance the radial expansion of the overall sleeve structure.

Furthermore, the internal surface of the sleeve is described as of tapered configuration and the external surface of the wedging core is complementally configured therewith, such internal surface taper desirably being inward toward the sleeve axis in the direction of the flange carrying end of the sleeve.

Finally, a described feature of the invention includes a hub member rotatably mounted on the shaft and the flange of the mandrel sleeve is received in an annular groove in the hub to thereby prevent axial movement of the sleeve relative to the shaft, such that proper superposed winding of the web on the reel take place without any edge overlap as might occur if there were tolerance for axial movement of the mandrel sleeve.

U.S. Pat. No. 3,792,868 describes a chuck for use in gripping a hollow member. A hexagonal shaft is provided with rollers and an outer gripping surface comprised of a plurality of members held together by bands. When driving force is applied to the spindle, the torque drives the rollers and the external surface outwardly to grip a bobbin or the like.

U.S. Pat. No. 3,667,697 describes a not dissimilar mandrel which had a triangular core inside the mandrel, and three studs which protrude through the mandrel outer housing. Upon torsional engagement, the studs are forced through the mandrel housing to deform an outer elastic ring and grip a bobbin of material.

EP 618161 describes a bobbin changing device, and therein notes that a transfer arm has a mandrel with an expandable head which is insertable only halfway into the core of a bobbin so that it may be transferred to another mandrel.

U.S. Pat. No. 4,798,349 describes a multiple bobbin loading system which automatically feeds bobbins to a mandrel. The mandrel is fitted with radially movable jaws which expand once a bobbin is placed on the mandrel and simultaneously lift and true the bobbin on the mandrel.

It is also known to use bobbins of material in a conversion process. Many apparatuses for such use are described and known, including laser perforation (e.g. U.S. Pat. Nos. 3,226,527; 3,965,327; 4,049,945; 4,118,619 (Re. 31,478); 4,121,595; 4,265,254; 4,302,654; 4,378,480; 4,404,454; 4,410,785; 4,439,663; 4,916,272; 4,767,909; 5,060,668; 5,092,350; 5,210,390; 5,403,990; and 5,404,889. Each of the above is incorporated by reference.

It is now becoming common to use dual track machines to save on expense, e.g. the Protos 2™ cigarette machine now comes with a dual track capability which utilizes two bobbins. It would be useful to provide a quick-release mandrel which adjusts its grip for each bobbin independently and provides a secure hold on the rather weighty paper bobbins used in cigarette manufacture.

II. BRIEF DESCRIPTION OF THE DRAWINGS

III. OBJECTS OF THE INVENTION

It is an object of the present invention to provide a mandrel for use in a dual-bobbin assemblage.

It is a further object of the present invention to provide a stable mandrel for use in a dual bobbin assemblage which provides improved axial torsional stability to prevent slippage.

It is an additional object to provide a long-wearing mandrel for use in high-speed manufacturing processes.

It is also an object to provide a mandrel which accommodates bobbins of varying core diameters simultaneously and reliably.

It is also an object of the present invention to provide a bobbin arrangement whereby two bobbins may be mounted on a single mandrel and released by a single actuator.

It is a further object of the present invention to provide an apparatus which may handle twice the volume of processing from a single side.

These and other objects will become readily apparent to the skilled artisan having regard for this disclosure.

IV. DETAILED DESCRIPTION

The present invention is directed to spindle apparatus and particularly a mandrel used for mounting a bobbin or reel for a web of material to be wound or unwound.

Suitable webs may be, by way of example, thermoplastic film, paper or the like. In the following exemplary embodiment of the present invention, the apparatus is intended for commercial utilization in a cigarette manufacturing operation or the preparation of materials for use in a cigarette manufacturing operation. More particularly, the apparatus is to be used in conjunction with the winding and unwinding of cigarette tipping paper onto or off of a bobbin or reel in laser perforation apparatus and machinery.

In operation, generally, the tipping paper is subjected to a perforation operation. The paper feeds from a takeoff reel through the perforating operation and back onto a takeup reel.

It would be desirable to increase speeds and efficiency, regardless of the method used, by utilizing simultaneous perforation of webs side-by-side. It would also be desirable to have a mandrel which prevents slippage of heavy bobbins of paper.

Figure 1:
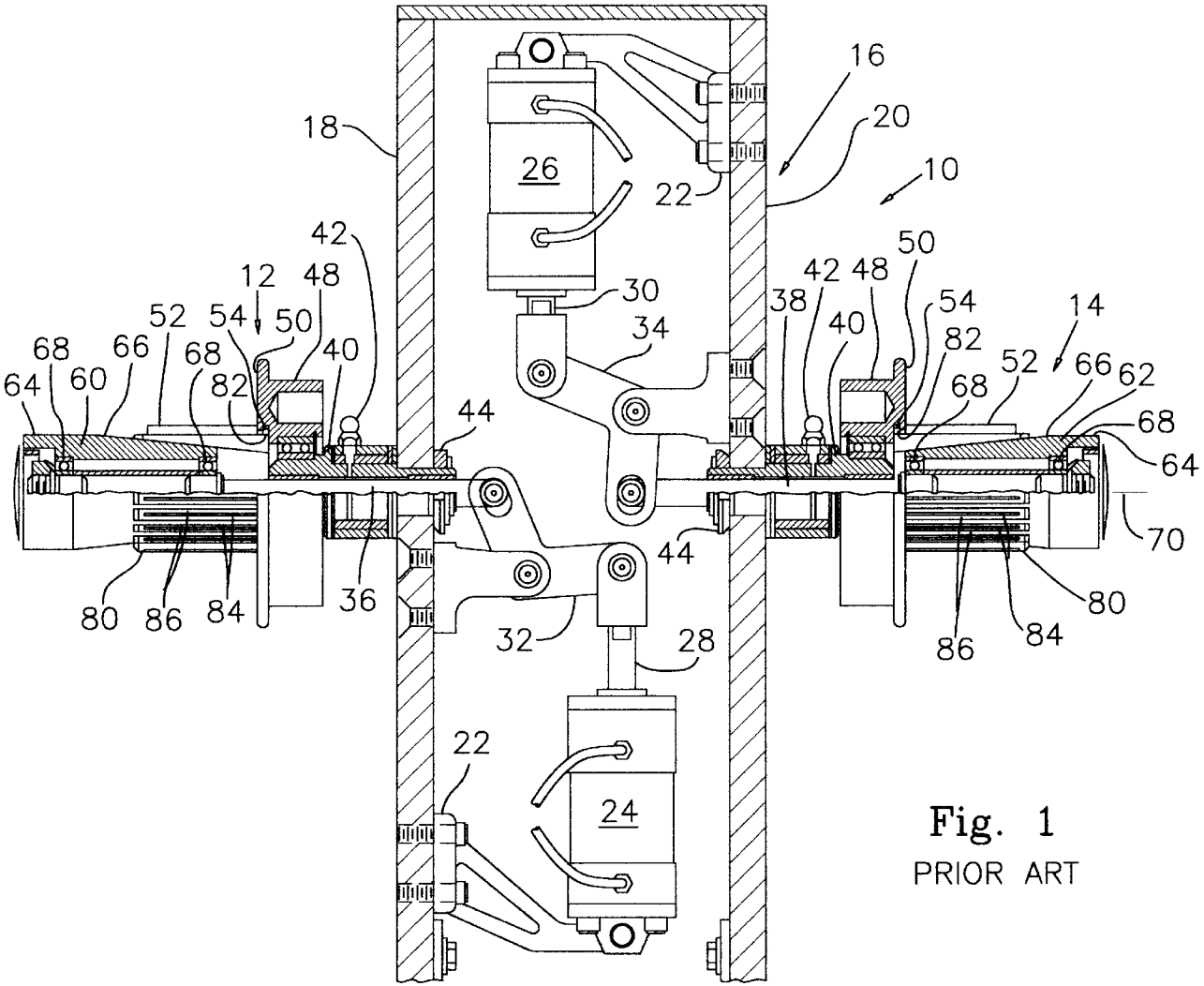
Fig. 1 PRIOR ART
FIG. 1 is a plan view of a prior art spindle apparatus.

Referring now to FIG. 1 of the drawing, the PRIOR ART apparatus 10 includes two spindle units 12, 14. In a particular use, two paper perforating units would be employed adjacent the apparatus shown one at each side of the wall enclosure unit 16. The wall enclosure unit has a pair of supporting walls 18 and 20 which is mounted for support from the walls at 22, a pair of actuating cylinder units 24, 26 which have their respective pistons 28, 30 connected to pivot arms 32, 34 which pivot arms in turn are connected to shafts 36, 38 fixed for sliding movement in the walls 18, 20.

The shafts 36, 38 are capable of movement along horizontal co-directional axes. The shafts 36, 38 pass through the walls and there is a bearing support unit 40 which can include suitable lubricator 42. The bearing support units 40 are secured by locking rings 44 at the inner sides of the walls 18, 20. Mounted on the bearing support units 40 and fixed for rotation on bearings 46 are hub members 48 which have flat face surfaces 50 against which can be received a side face of a reel 52 (shown in phantom lines), the hub members having an internal annular groove 54.

Carried at the ends of the shafts 36, 38 are wedging core members 60, 62, the external surface of the wedging cores transiting from a cylindrical outer surface as at 64 to a uniformly conically shaped tapering outer surface as at 66. The wedging cores are as shown mounted on bearings 68 so that the same are rotatable about the fixed axis 70 of the shafts 36, 38.

The wedging cores 60, 62 are fixed longitudinally vis-a-vis movement with the shafts 36, 38. Sliding the shafts in each of two opposite directions will also cause longitudinal sliding of the wedging cores. The mandrel 80 encircles the tapered surfaces of the wedging cores 60, 62, and is the structure on which the reels 52 are received. The mandrel 80 is a hollow cylindrical sleeve having an external flange 82 at one end which is received in the annular grooves 54 of the hubs 48. Sliding movement of the shafts and wedging cores causes expansion of the mandrels but no longitudinal displacement relative to the shafts.

The mandrel sleeve is further characterized by the presence therein of a plurality of axially directed slits 84 which extend circumferentially uniformly spacedly around the sleeve with adjacent ones of the slits extending from opposite tip ends of the sleeve in the direction of the other sleeve and terminating closely adjacent to but spaced from the said other sleeve end.

The slits 84 intervene ribs 86 formed in the sleeve so that each rib has connecting structure at one end which is integral with the succeeding next adjacent rib; and a connecting structure at the other end which is integral with the preceding next adjacent rib. Thus an alternating arrangement of connecting structure segments at the opposite ends of the sleeve is created.

The spindle unit shown at the left side of FIG. 1 depicts a reel member received on the mandrel when the latter is in contracted position. Thus, the reel is loosely positioned on the mandrel. However, the expansion of the sleeve as depicted at the right side spindle unit in FIG. 1 causes tight engagement of the outer surface of the mandrel with the inner surface of the reel. For effecting expansion of the mandrel, the wedging cores are slid in an appropriate direction producing a wedging effect against the inner surface of the sleeve to expand it.

The internal surface of the sleeve tapers in complemental configuration with the wedging core with the taper; tapering inwardly towards the sleeve axis in the direction of the flange carrying end of the sleeve.

Figure 2:
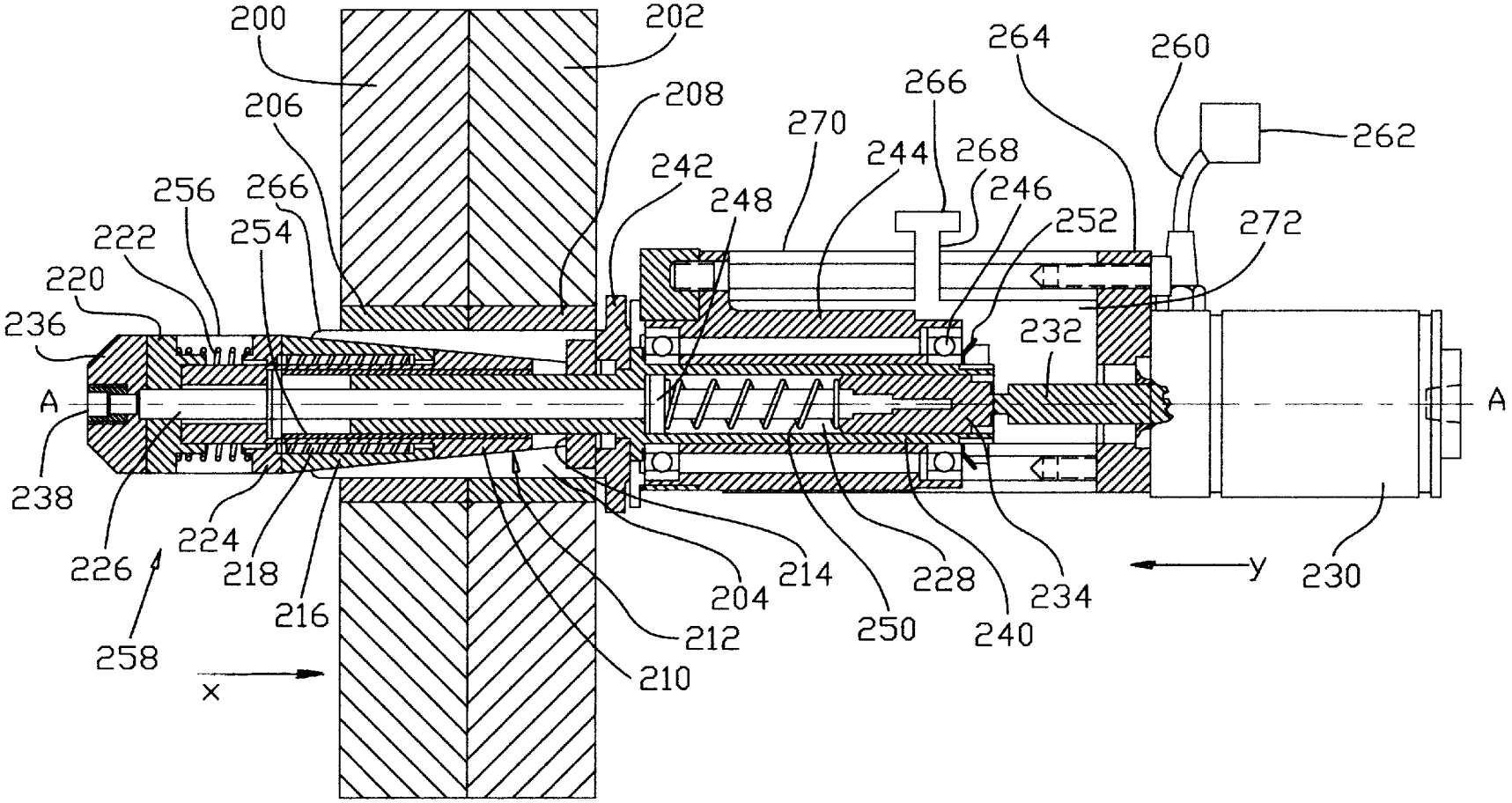
FIG. 2 is a side view of the novel mandrel of the present invention.

Leaving the PRIOR ART and turning now to exemplary FIG. 2, the differences between the prior art shaft and the novel mandrel of the instant invention may be more clearly seen.

Outer bobbin 200 and inner bobbin 202 are mounted upon an extended hollow mandrel 204. Outer core 206 and inner core 208 are in physical contact with the mandrel 204. In an expanded state, the cores are firmly gripped by the surface of the mandrel, and in a contracted state, the cores loosely slide over the surface of the mandrel.

Mandrel 204 is a hard wearing but flexible material, such as steel, aluminum, or an appropriately selected alloy which exhibits sufficient strength and deformability, yet is capable of withstanding great rotational speeds.

Mandrel 204 may be physically of a form such is as known by the skilled artisan having regard for this disclosure, e.g that in FIG. 1 with expanding rib structure. Alternately, a dense and hard thermoplastic material may be used; provided such material has sufficient strength to carry the weight of two fully loaded bobbins under torsional stresses associated with linear speeds of up to and greater than 1000 m/min.

Within hollow mandrel 204 is a primary tapered expander 210. Primary tapered expander 210 is longitudinally displaceable along axis A a distance between a fully extended point, e.g. at arrowhead 212, inwardly as far as retaining ring surface 214. As bobbins take their toll on the mandrel surface by wear or the like, these distances may be calibrated for better fits to assure a firm and secure mounting of the bobbin on the mandrel. The tapered expander is preferably generally frustro-conical in shape with a hollow cylindrical interior.

To secure the bobbin, the tapered expander is pulled inwardly in the direction of arrow X, driving the mandrel axially expandingly within bobbin core 208. The inner bobbin 202 is thus stabilized and secured by the expanding action of the primary expander.

Secondary expander 216 is separated axially from primary expander 210 by a bushing 218. Such bushing may be any sufficiently durable material, bronze presently being preferred for machinability, flexibility, and hardness. Other suitable materials may, however, be chosen. Primary expander 210 is fitted with end cap 220.

End cap 220 retains adjustment spring 222 over primary expander 210 and compresses it against ring 224 which is attached to secondary expander 216. Adjustment spring is exemplary of a variety of resilient members which may be suitable for the task.

Under the influence of mechanical, electrical, or pneumatic actuator 230, the actuator shaft 232 pushes against abutting but preferably unattached sliding member 234, which is slidingly housed in the cavity 228 of hollow axle member 240.

This action applies pressure to compress biasing spring 250 and central rod 226 in an outward direction (as illustrated in arrow Y). To allow for this longitudinal motion, sliding member 234 and central rod 226 are slidably mounted in the cavity 228 of hollow axle member 240. Longitudinal motion is halted in the "X" direction by the actuator shaft 232 and in the "Y" direction by the limits of compressibility of biasing spring 250 against washer 248. Central rod 226 passes through washer 248.

In operation, central rod 226 is normally pulled inwardly, e.g. by biasing spring 250. This is also an important safety feature, e.g. in the event of a power loss to the machine a heavy, rapidly spinning bobbin will not be set loose.

Hollow axle member 240 is free to rotate about axis A shown in dotted line in FIG. 2. Hollow axle member 240 is connected to the mandrel 204 by joint 242, which is preferably a circular bracket bolted to the hollow axle member and mandrel. The hollow axle housing is held in place by retaining sleeve 244, and rotatably secured by bearings 246 and shims 252.

Turning now to the mandrel head, it may be seen from the figure that assembly end cover 236 is adjustably mounted to central rod 226 and is carried along with rod 226 when it is translated longitudinally along or spinningly about axis A. End cover 236 is provided with adjustment device 238, which may be a threaded screw or bolt as shown which attaches to the central rod and may be adjustable to fine tune the degree of expansion.

End cover 236 is in physical contact with end cap 220 which is fixedly connected to central rod 226, and physically pulls or pushes primary expander 210 to seat or unseat, respectively, the inner bobbin. Primary expander 210 is provided with tubular bushing 254, allowing it to freely translate or float along the external surface of hollow axle member 240.

End cover 236 pulls or pushes the end cap 220 in response to actuator shaft 232, which decompresses or compresses adjustment spring 222. This in turn compresses or releases secondary expander 216 to seat or unseat outer bobbin 200 by expanding or releasing the mandrel 204 to contract. This action allows the mandrel 204 to resiliently adjust independently to each bobbin along its length.

A shield 256 protects the adjustment spring from externally inflicted damage and allows for smooth passage of the bobbins over the mandrel head.

Thus, a longitudinally translatable free spinning assembly of very low mass is assembled. This configuration yields several unexpected benefits—giving long life compared to more bulky assemblies by reducing the frictional drag on the machine; eliminating ball bearing type joints for improved durability and reduced maintenance; and higher reliability and therefore improved processing efficiency.

For ease of reference, a bobbin changing operation will now be described with reference to FIG. 2.

Fully loaded bobbins 200 and 202 are to be mounted onto mandrel 204. The mandrel 204 in that state would be in its most contracted condition, i.e. actuator shaft 232 is fully extended in the direction of arrow Y. Sliding member 234 would be pushed in the same direction, and slide within hollow axle member 240, carrying mandrel head 258 outwardly. This would carry primary expander 210 outwardly, releasing the inner portion of mandrel 204; while simultaneously end cap 220 would release the compression on adjustment spring 222, and hence the secondary expander 216 would be free to move outwardly and be carried by primary expander 210 out of mandrel 204.

Cores 200 and 202 would then be slid onto mandrel 204 up to ring joint 242.

Actuator 230 would then be withdrawn under the influence of air pressure delivered, e.g. through connector 260 from controlled source 262 to pneumatic actuator 230.

Alternatively, 260 may be a control cable connection to a controller 262 which delivers power to actuator 230 which may be a solenoid or the like. The entire apparatus may be mounter, e.g. by bolts, to a machine component 264.

When actuator 230 would be withdrawn, actuator shaft 232 would release the sliding member 234, and the biasing spring 250 would push sliding member 234 and hence central rod 226 longitudinally in the "X" direction. End cover 236 and end cap 220 would be drawn by central rod 226 in the "X" direction, and drive primary expander 210 within mandrel 204. Adjustment spring 222 would then be compressed, and drive secondary expander 216 under mandrel outer portion 266. Both bobbins are then firmly seated with little chance of slippage or unseating during high torque and speed operations.

In an alternative arrangement, the actuator 230 could be a motor, and vacuum/pressure source 267 could be connected by duct 268 to the interior of housing 270. A vacuum or pressure could be formed within housing 270 which defines a chamber 272 of reduced or increased pressure. Under increased pressure, the sliding member 234 would be driven outwardly in the "Y" direction to release the bobbins, and under reduced pressure and the spring biasing the sliding member would be driven inwardly in the "Y" direction.

Figure 3:
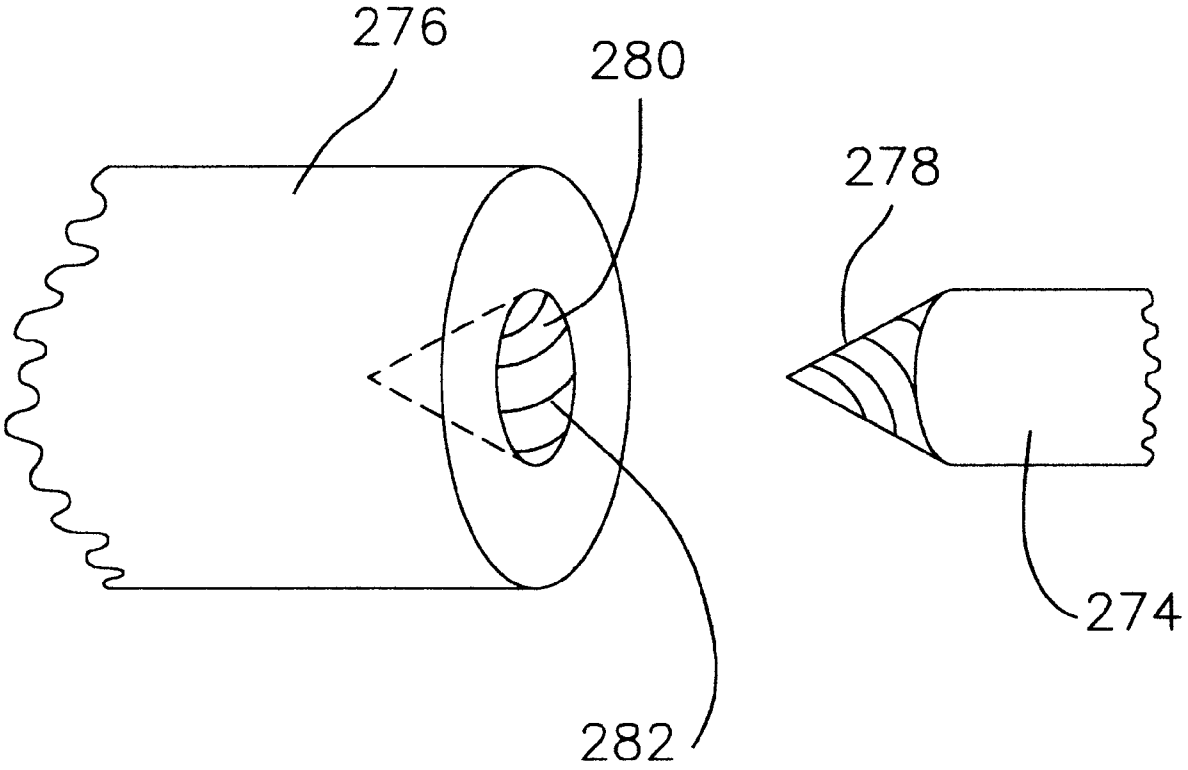
FIG. 3 illustrates how the motor shaft is seated in the sliding member

Turning to FIG. 3, the motor shaft 274 would then be seated in the end of alternative sliding member 276. Motor shaft 274 could be formed with ridges or threaded surface 278 which would have corresponding receiving socket 280 with ridges or threads 282. The respective ridges or threads would be configured such as to seat more firmly under torque from the motor shaft.

Thus, in a preferred arrangement a singularly powered spindle with the novel mandrel would be provided with the benefits of the instant invention.

Having described the invention as above, we claim:

1. An apparatus for adjusting the expansion of a mandrel which is capable of seating a plurality of bobbins having cores on a single spindle, comprising:

a rod slidable along a fixed axis;

a first expansion member fixed to said rod and concentric with said fixed axis, a second expansion member concentric with said fixed axis;

a resilient member between said first expansion member and said second expansion member; and an expandable-contractible mandrel encircling said expansion members and on which said plurality of bobbins are receivable, whereby sliding of said rod in one direction effects movement of said first expansion member into expanding contact with said mandrel for expanding same against a bobbin core, and sliding of said rod also acts upon said resilient member to effect movement of said second expansion member into expanding contact with said mandrel for expanding same against a different bobbin core.

2. The apparatus of claim 1 wherein the resilient member is a spring.

3. The apparatus of claim 1 wherein the expansion members are frustro-conical with an external tapered configuration, and the internal surface of said mandrel is formed with a corresponding tapered configuration.

4. The apparatus of claim 1, further comprising a biasing member which acts to bias the rod in the one direction for expanding the mandrel.

5. The apparatus of claim 1, further comprising an actuator for moving the rod in a longitudinal direction along the fixed axis.

6. The apparatus as claimed in claim 5, wherein the actuator is electrical.

7. The apparatus as claimed in claim 6, wherein the actuator is a solenoid.

8. The apparatus as claimed in claim 5, wherein the actuator is pneumatic.

9. The apparatus as claimed in claim 8, further comprising a pneumatic chamber and vacuum or air pressure source communicating with said chamber, whereby said rod is driven in a longitudinal direction.

10. The apparatus as claimed in claim 9, further comprising a driver for imparting angular rotation to said rod, said driver being releasably engagable with said rod.

11. An apparatus as claimed in claim 1, wherein the rod is adjustable longitudinally relative to the expansion members.

12. An apparatus for adjusting the expansion of a mandrel which is capable of seating a first and a second bobbin, each bobbin having a core, on a single spindle, comprising:

a rod slidable along a fixed axis and connected to a biasing device;

a first expansion member fixed to said rod and concentric with said fixed axis, a second expansion member concentric with said fixed axis;

a resilient spring member between said first expansion member and said second expansion member; and an expandable-contractible mandrel encircling said expansion members and on which said plurality of bobbins are receivable, whereby sliding of said rod in one direction effects movement of said first expansion member into expanding contact with said mandrel for expanding same against a bobbin core, and sliding of said rod also acts upon said resilient member to effect movement of said second expansion member into expanding contact with said mandrel for expanding same against a different bobbin core.

13. An apparatus as claimed in claim 12, wherein the first expansion member is substantially in the same vertical plane as the first bobbin, and the second expansion member is substantially in the same vertical plane as the second bobbin.

14. An apparatus as claimed in claim 12, wherein the apparatus is housed in a cigarette making machine.

15. An apparatus as claimed in claim 12, wherein the apparatus is housed in a converting machine.

16. An apparatus as claimed in claim 12, further comprising a protective sleeve covering the resilient member.

17. An apparatus as claimed in claim 12, further comprising at least one bushing separating the expansion members.

18. An apparatus as claimed in claim 17, wherein the bushing is bronze.

19. An apparatus as claimed in claim 12, wherein the rod is adjustable longitudinally relative to the expansion members.

20. An apparatus for adjusting the expansion of a mandrel which is capable of seating a first and a second bobbin, each bobbin having a core, on a single spindle, comprising:

a rod slidable along a fixed axis and connected to a biasing device;

a first expansion member fixed to said rod and concentric with said fixed axis, a second expansion member concentric with said fixed axis;

a resilient spring member between said first expansion member and said second expansion member; and an expandable-contractible mandrel encircling said expansion members and on which said plurality of bobbins are receivable, wherein the mandrel is biased by a biasing member into an expanded position, and an actuator controlled by a control device provides longitudinal displacement to overcome the biasing force, whereby the control device selectively controls the sliding of said rod in one direction to effect movement of said first expansion member into expanding contact with said mandrel for expanding same against a bobbin core, and sliding of said rod also acts upon said resilient member to effect movement of said second expansion member into expanding contact with said mandrel for expanding same against a different bobbin core, and in a second direction to effect contraction of the mandrel from beneath each respective bobbin core.

* * * * *